US007575139B2

(12) United States Patent
Thompson

(10) Patent No.: US 7,575,139 B2
(45) Date of Patent: Aug. 18, 2009

(54) EXPLOSIVE DISCHARGE ACTUATED TOOL FOR DRIVING FASTENERS

(75) Inventor: William J. Thompson, Newport Beach, CA (US)

(73) Assignee: Tomarco Contractor Specialties, Inc., La Mirada, CA (US)

( * ) Notice: Subject to any disclaimer, the term of this patent is extended or adjusted under 35 U.S.C. 154(b) by 0 days.

(21) Appl. No.: 12/192,811

(22) Filed: Aug. 15, 2008

(65) Prior Publication Data

US 2008/0302846 A1 Dec. 11, 2008

Related U.S. Application Data

(63) Continuation-in-part of application No. 11/716,490, filed on Mar. 8, 2007.

(51) Int. Cl.
*B25C 1/14* (2006.01)

(52) U.S. Cl. ..... 227/10; 227/9; 227/11

(58) Field of Classification Search ..... 227/10, 227/9, 11

See application file for complete search history.

(56) References Cited

U.S. PATENT DOCUMENTS 3,382,751 A 5/1968 Kofpf
3,491,933 A 1/1970 Thurner et al.
3,516,323 A 6/1970 O'Brien
3,552,625 A 1/1971 Udert
3,556,379 A 1/1971 Bayer et al.
3,589,584 A 6/1971 Ohlsson et al.
3,622,060 A 11/1971 Gussalli
3,675,838 A 7/1972 Bakoledis
3,851,416 A 12/1974 Engström et al.
3,915,242 A 10/1975 Bell
3,973,708 A 8/1976 Scotoni
4,028,986 A 6/1977 Benton
4,063,672 A 12/1977 Jochum
4,066,199 A 1/1978 Jochum et al.
4,114,792 A 9/1978 Pomeroy
4,687,126 A 8/1987 Brosius et al.
4,804,127 A 2/1989 Kirkman
5,425,488 A 6/1995 Thompson
5,429,291 A 7/1995 Thompson
5,569,010 A 10/1996 Janssen et al.
5,624,220 A 4/1997 Janssen et al.
6,547,120 B1 4/2003 Popovich et al.
6,981,630 B2 1/2006 Popovich et al.
7,182,565 B2 2/2007 Buytaert et al.
2005/0035172 A1 2/2005 Popovich et al.
2007/0053768 A1 3/2007 Durig

*Primary Examiner*—Brian D Nash

(57) ABSTRACT

An explosive discharge actuated tool for driving fasteners has a barrel with a closed bore, an interchangeable nose piece to accommodate different length fasteners and a piston that is manually reset to firing position by a spacer-fastener being inserted into the barrel.

19 Claims, 7 Drawing Sheets

FIG. 7
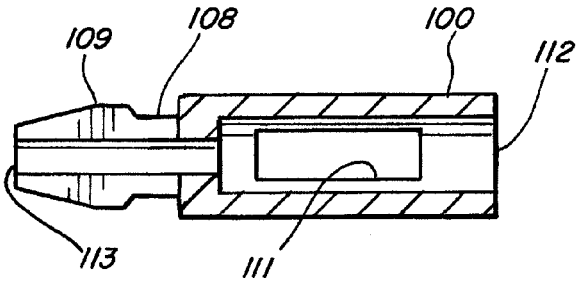
FIG. 8
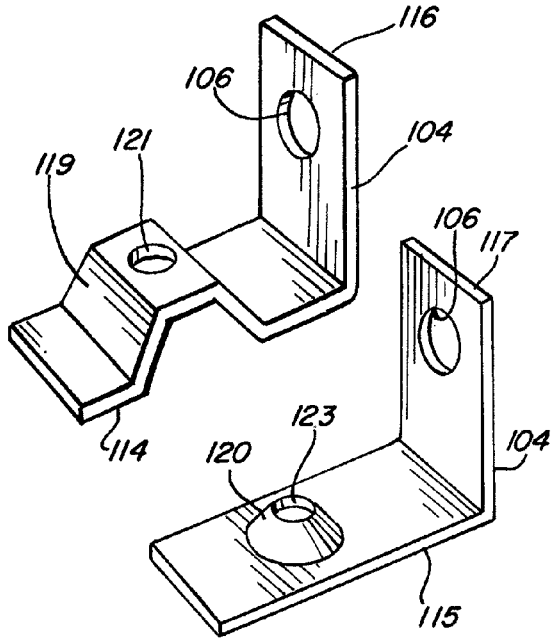
FIG. 6
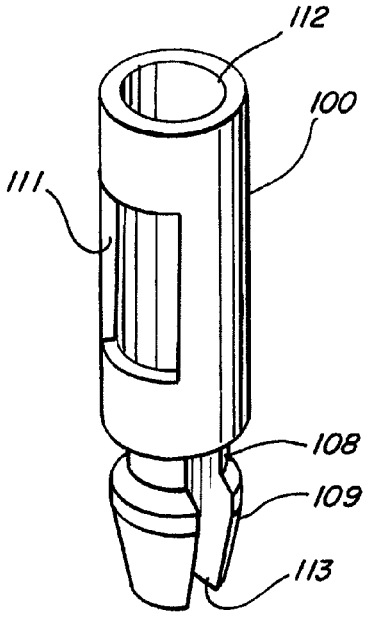
FIG. 9
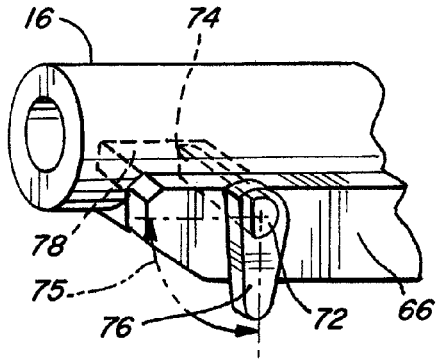
FIG. 10

EXPLOSIVE DISCHARGE ACTUATED TOOL FOR DRIVING FASTENERS

CROSS-REFERENCE TO RELATED APPLICATIONS

This application is a continuation-in-part of application Ser. No. 11/716,490 filed on Mar. 8, 2007 for Explosive Discharge Actuated Tool For Driving Fasteners. This application is related to application Ser. No. 12/076,727 filed on Mar. 28, 2008 for Explosive Discharge Actuated Tool for Driving Fasteners which is a continuation-in-part of application Ser. No. 11/716,490 filed Mar. 8, 2007.

BACKGROUND OF THE INVENTION

1. Field of the Invention

The present invention relates generally to improvements to apparatus for driving fasteners into hard surfaces such as concrete, aggregate surfaces, structural elements and similar structures, and more particularly pertains to a new and improved explosive discharge actuated tool which fires an explosive discharge cartridge only upon the muzzle of the tool being forced against the work surface.

2. Description of Related Art

Generally, non-explosive discharge actuated tools that drive fasteners into hard surfaces utilize single fastener loading devices. The desired fastener device is inserted into the muzzle or discharge end of the barrel of the tool. A piston or fastener actuator is slidably disposed in the barrel to be actuated by the gas of an explosive discharge, such as a powder cartridge, to propel the fastener out of the barrel into the structural element or work surface of the structural element.

Single load fastener tools normally retract the fastener actuator or piston and move a new explosive cartridge into the firing chamber in two operational steps. Retraction of the piston to a firing position allows insertion of a fastener at the barrel muzzle end. While such a tool may not be cocked for firing, or a safety mechanism may be activated to prevent forward motion of the firing pin, accidental discharge of a cartridge is still possible. Such accidental discharge could cause injury to a person attempting to load the tool with the fastener element. All of these explosive discharge actuator tools utilize a safety device that prevents accidental discharge by requiring that the barrel muzzle be pressed against the work surface of a structural element in order to enable the trigger on the tool to be pulled and explode the cartridge.

These tools utilize a piston reset method that is not related to the fastener that is loaded into the muzzle of the tool. Furthermore, the tools are required to accept and drive fasteners of various lengths. As a result, when a fastener is loaded into the muzzle, there is usually a space or void separating the drive piston from the fastener. This length of the space varies depending on the length of the fastener being utilized. The space between the piston and the fastener directly affects the driving force and subsequent penetration of the fastener into a work surface. Such explosive discharge actuated tools are very loud, somewhat bulky, and heavy, which causes fatigue during long periods of use.

Heretofore, explosive discharge actuated tools have been somewhat cumbersome, heavy and loud.

SUMMARY OF THE INVENTION

A compact, lightweight, but powerful, silent explosive discharge actuated tool for driving fasteners of the present invention utilizes a barrel with a bore that only has an opening at the leading end and trailing end of the barrel. An interchangeable muzzle nose piece of variable length threads into the front end of the barrel, the muzzle engages with the opening at the leading end of the barrel. A piston sized to fit the barrel bore is attached to a piston rod sized to fit the bore in the muzzle nose piece. A spacer-fastener of predetermined length fits into the muzzle bore and moves the piston rod and piston back in the bore, so that the trailing end of the piston is at the trailing end of the barrel bore and the spacer-fastener and piston rod are in physical contact in the firing position.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein:

FIG. 6 is a perspective of the spacer of the present invention.

FIG. 7 is a side view cut away of the spacer of FIG. 6.

FIG. 8 is a perspective of a fastening clip according to the present invention.

FIG. 9 is a perspective of a preferred embodiment of a fastening clip according to the present invention.

FIG. 10 is a partial perspective of a barrel container according to the present invention.

DETAILED DESCRIPTION OF THE PREFERRED EMBODIMENTS

Figure 1:
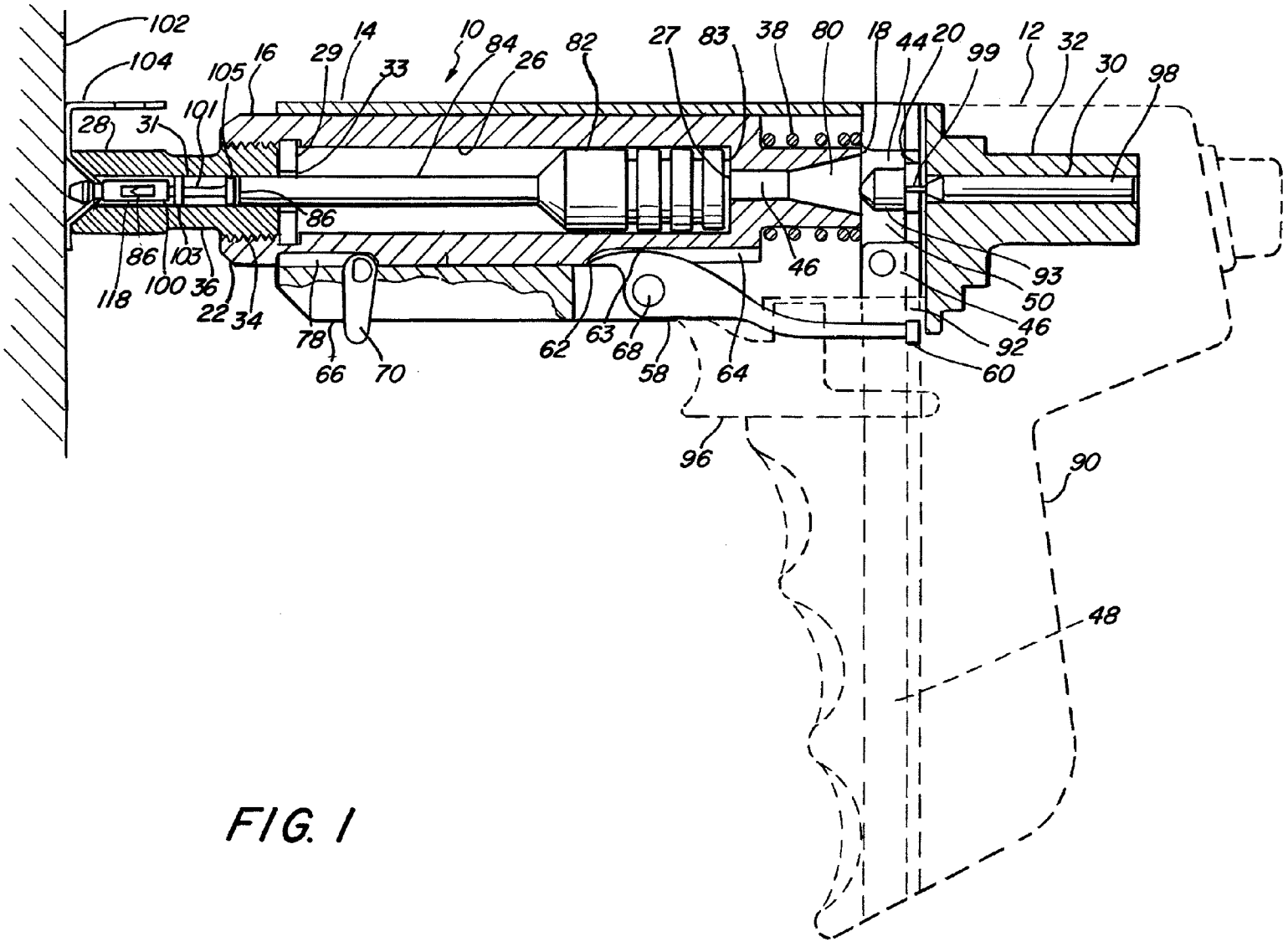
FIG. 1 is a side view partially cut away of a tool according to the present invention.

FIG. 1 illustrates a preferred embodiment of the explosive discharge actuated tool 10 of the present invention in position to fire against a surface 102 of a structural element to which a fastener 101 is to be attached, before a loaded cartridge is advanced to the firing chamber 44 by cartridge advancing arm 58. Cartridge 93 shown in FIG. 2 is a spent cartridge.

Figure 2:
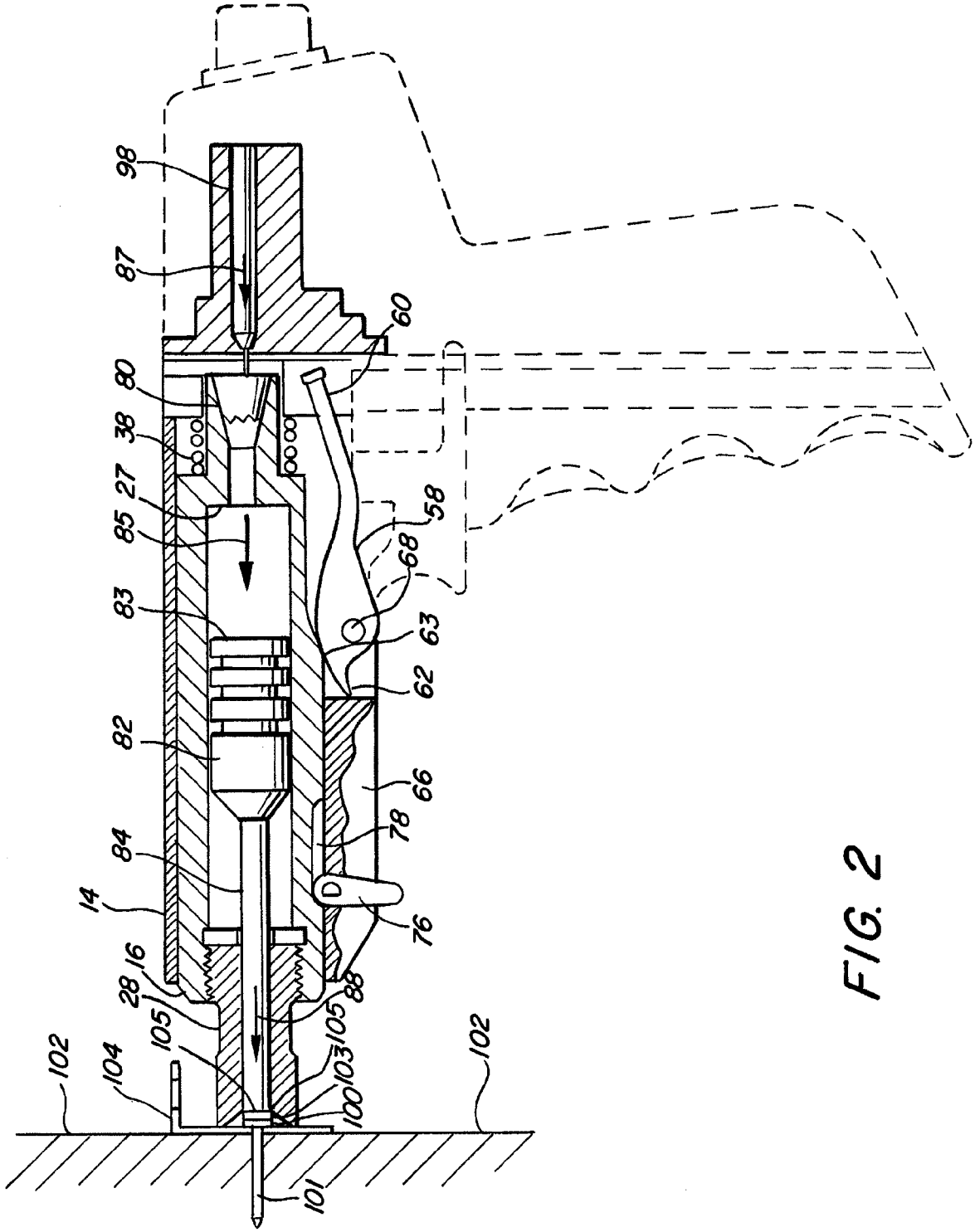
FIG. 2 is a side view partially cut away of the tool of FIG. 1 at the end of its firing cycle.

By pressing the tool 10 into the work surface 102, the barrel 16 is pushed back against the force of spring 38, causing the cam end 62 and cam surface 63 to rotate about pivot pin 68, as shown in FIG. 2. This action advances a loaded cartridge into the firing chamber 44 under firing cone 80 which covers the cartridge. At that point, trigger 96 is free to be pulled, causing firing pin 98 to drive firing pin tip 99 into the cartridge, exploding it.

As can be seen in FIG. 2, movement of the firing pin 98 in the direction 87 causes the cartridge in firing chamber funnel 80 to explode, releasing its entire force in direction 85 against the trailing end 83 of piston 82, driving it and piston rod 84 in a forward direction 88.

The force exerted by the piston rod 84 on the nail head 105 drives the nail 101 into the work 102, pinning a fastener clip 104 against the work surface 102 of the structural element with a crushed spacer 100 and a frangible disk 103 on the other side of the fastener clip 104, are compressed by the nail head 105.

FIG. 2 shows the tool at the end of the firing cycle with the barrel 16 still being depressed against the work surface 102 of the structural element. The barrel 16 is still retracted into the receiver housing 14. Once released, as shown in FIG. 3, the barrel 16, as the result of spring 38, moves forward in receiver housing 14, causing the advancing arm 58 to reset as shown, but leaving the piston 82 and piston rod 84 in the fired position, as shown in FIG. 2, with piston rod 84 occupying the muzzle bore 31 (FIG. 1) of the nose piece 28.

Figure 3:
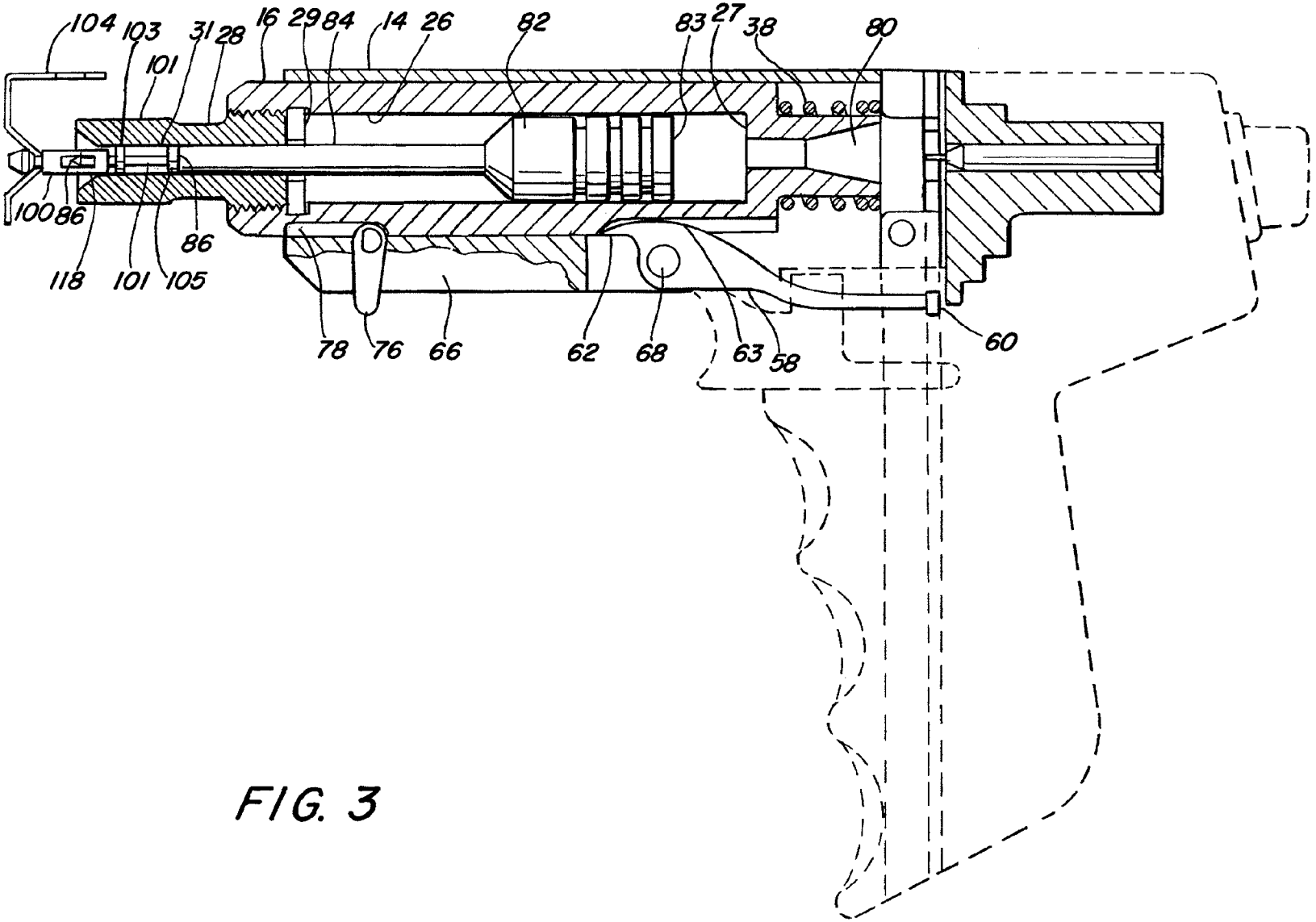
FIG. 3 is a side view partially cut away of the tool of FIG. 1 during the reloading cycle.

As shown in FIG. 3, insertion of spacer-fastener 118 into the muzzle bore 31, piston rod 84 and piston 82 to be moved back, away from the leading end 29 of barrel bore 26 to the trailing end 27 of barrel bore 26.

Figure 4:
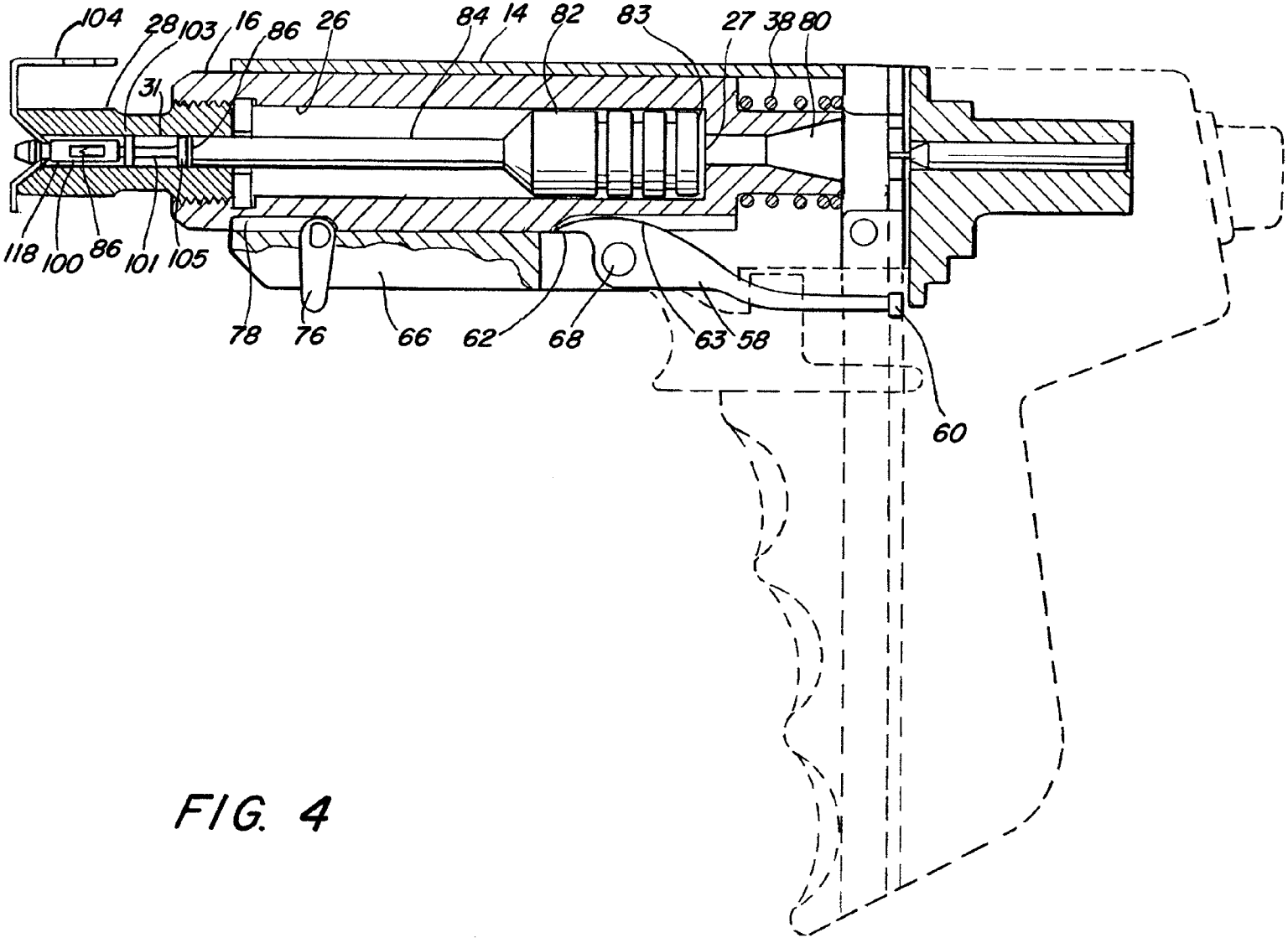
FIG. 4 is a side view partially cut away of the tool of FIG. 1, reloaded.

As shown in FIG. 4, the length of spacer-fastener 118 is related to the length of muzzle nose piece 28 so that it has sufficient length to move piston rod 84 and piston 82 sufficiently backwards causing the trailing end 83 of piston 82 to be against the trailing end 27 of barrel bore 26, with the head 105 of nail 101 in physical contact with the leading end 86 of piston rod 84. FIG. 4 shows the alignment of the piston 82, piston rod 84, and spacer-fastener 118 in a ready to fire position.

FIG. 1 also shows the ready to fire alignment. FIG. 2 on the other hand, shows the piston in a just fired position. While FIG. 3 shows the piston being moved back by the spacer-fastener 118 into its ready to fire position.

Figure 5:
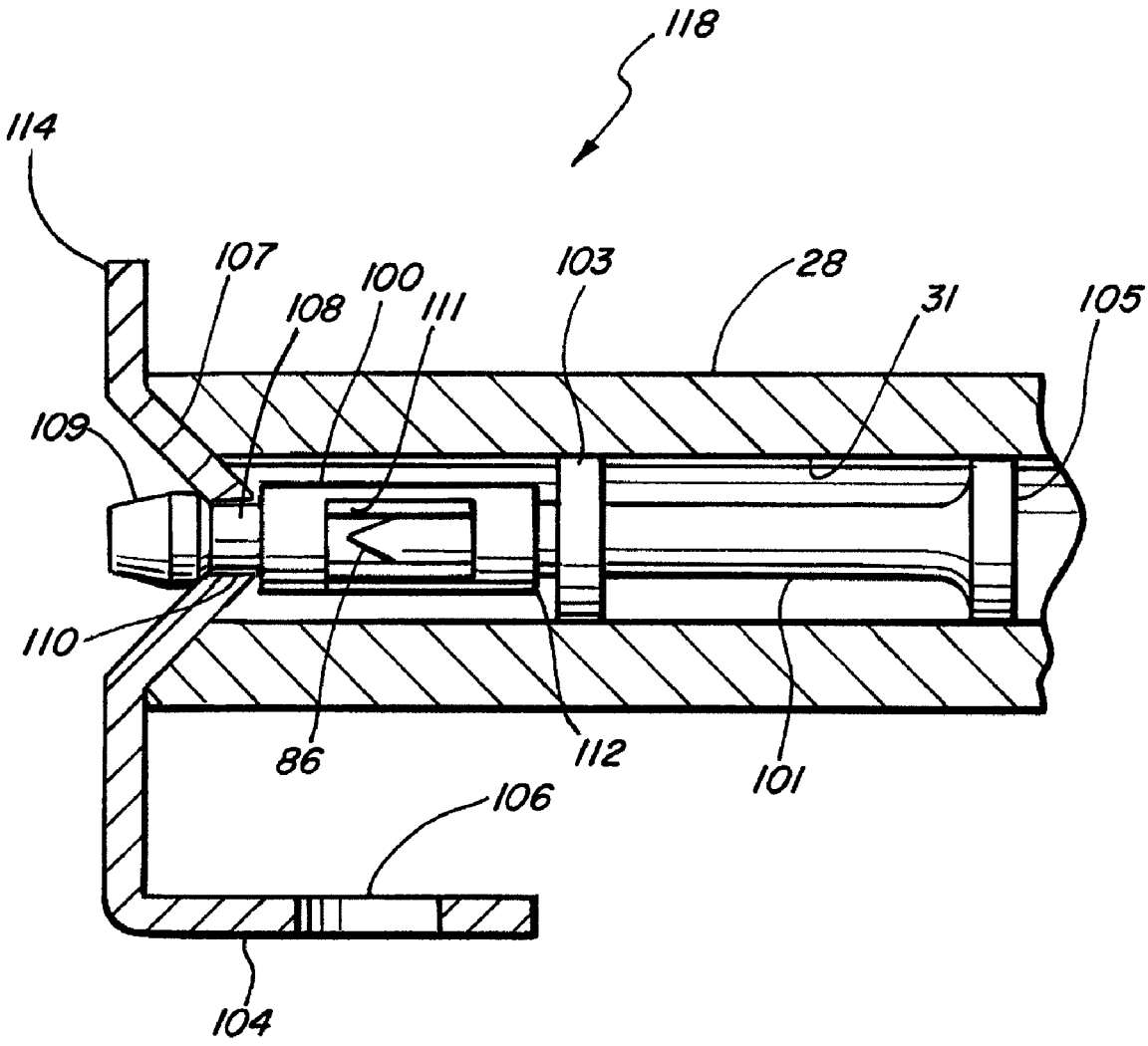
FIG. 5 is a side view cut away of the muzzle of the tool of FIG. 4 showing the spacer-fastener of the present invention.

The spacer fastener 118 which is more clearly illustrated in FIG. 5 placed inside the bore 31 of the muzzle nose piece 28 has a length related to the muzzle nose piece 28 and tool, in that it has the length required to reset the piston and piston rod to the desired position for firing. The spacer-fastener 118 has a frangible spacer 100 that is made of plastic or similar frangible material that receives the tip 86 of the nail 101 at its trailing end 112, thereby holding the nail 101. A frangible disk, such as a washer 103 is secured to the shaft of nail 101 between spacer 100 and the nail head 105 helping to stabilize the nail 101 within the bore 31 of muzzle nose piece 28, without impeding forward motion of the spacer-fastener 118.

Referring now to FIG. 6 which illustrates the spacer 100, the spacer body is cylindrical with an open trailing end 112 and a split knob 109 at the leading end. Apertures 111 are cut into the side of cylindrical spacer 100 to improve frangibility and decrease resistance to the nail driving force.

FIG. 7 illustrates the spacer 100 in cross section, more clearly showing a channel 113 through split knob 109 with a neck 108 located between a bulbous portion of knob 109 and the cylindrical end of spacer 100.

The shape of knob 109 with its neck 108 is designed to easily attach to a uniquely designed fastener clip 116, or fastener clip 117. The neck 108 of the knob has a diameter that is smaller than the diameter of apertures 121, 123 in the fastener clips 116, 117.

The fastener clip 116, as shown in FIG. 8 is L-shaped. One leg 114 of fastener clip 116 has a convex curvature with an aperture 121 at its apex. The other leg 104 of fastener clip 116 has an aperture 106 to accommodate attachment to items to be supported by the fastener clip after it is attached to the working surface of a structure.

Fastener clip 117, as shown in FIG. 9, is also L-shaped with one leg 115 having a convex surface 120 with an aperture 123 at its apex. The other leg 104 has an aperture 106 for attachment to anything that needs to be supported.

Spacer 100 physically attaches to fastener clip 116 or 117 by simply inserting split knob 109 into aperture 121 or aperture 123. With a exertion of forward force, split knob 109 compresses to pass through the respective apertures to the other side of the leg 114 or 115, with the neck 108 of spacer 100 resting in the aperture 121 or 123, after split knob 109 has once again expanded.

The convex shape 119 and 120 of the legs 114, 115 of fastener clips 116 and 117, respectively, are designed to nestle into the concave end 107 of muzzle nose piece 28, as shown in FIG. 5. This arrangement provides for further stabilization of the spacer-fastener 118 within the tool 10 and enhances alignment with the working surface 102 of a structural element that it is to be fastened to.

The spacer 118 is selected to have a length that not only moves the piston 82 into firing position as shown in FIGS. 1 and 4, but locates the point 86 of nail 101 a preset distance away from the surface 102 of the structural element. A preferred stand-off distance for the point 86 of nail 101 is about ⅜ inches. ***

The above description of the tool, according to the present invention, and specifically, the arrangement and interaction of the piston 82 in the closed barrel 16 with the piston rod 84 and the spacer-fastener 118 within the muzzle base 31, provides a tool that is lighter and smaller than comparable tools in the market. Comparison of a tool incorporating the present invention, called the Tomarco Powder Puff™ with three typical tools in the market, is presented below:

WEIGHT AND SIZE COMPARISON

| | Weight | O.A.L. |
|---|---|---|
| Tomarco Powder Puff ™ | 3.58 lbs. | 10⅞" |
| Hilti DX351 | 4.97 lbs. | 16" |
| Powers P3500 | 5.18 lbs. | 13⅜" |
| ITW Ramset Rocket | 5.28 lbs. | 17¼" |

Because the tool of the present invention is designed with a closed barrel having a bore 26 that is open only at the leading end of the bore at the muzzle bore aperture 33 and the trailing end 27 of the bore 26 by firing chamber funnel 80, all the explosive force of the cartridge is focused on the trailing end 83 of piston 82. This provides for nail penetration that is comparable to that provided by the larger, heavier tools in the market, which are typical of the type identified above.

Besides packing as much driving power as the larger fastening tools on the market, the tool of the present invention, is known as the "Powder-Puff," for a reason. It is quieter than all the other tools in the market. The tool of the present invention was tested against the Powers P3500 fastening tool, the Ramset Viper fastening tool, and the Hilti DX351 fastening tool.

An independent laboratory, Western Electro-Acoustic Laboratory, conducted a series of noise measurements on these three fastening tools, and the tool of the present invention, the Tomarco "Powder-Puff." Each of the tools were used in their normal mode to fasten a nail through a washer into a concrete slab. The concrete slab was approximately 18"× 12"×6". The measurements were made in a WEAL Anechoic Chamber. Bruel & Kjaer, sound analyzers, microphones and calibrators were used in the test. The test was conducted by having each fastening tool shoot a series of five fasteners through a washer into a concrete slab. Measurements were taken at approximately a 45° angle above the slab at a distance of 59 inches from the contact point on the slab. The sound level meter was set to fast response. For each shot location, the maximum A-weighted level was recorded. Five separate shots were measured for each of the four fastening tools. The five measurements for the five operations for each tool were averaged arithmetically to obtain a representative maximum level for each tool.

The below table indicates the results.

| | Fastening Tool | | | |
|---|---|---|---|---|
| Event | Powers P3500 | Ramset Viper | Hilti DX351 | Tomarco "Powder-Puff" |
| 1 | 100.4 | 97.2 | 96.1 | 90.2 |
| 2 | 101.2 | 94.2 | 93.6 | 88.2 |
| 3 | 95.5 | 101.6 | 93.2 | 89.4 |
| 4 | 99.9 | 96.8 | 93.6 | 89.6 |
| 5 | 99.1 | 94.7 | 94.2 | 89.8 |
| Average | 99.2 | 96.9 | 94.1 | 89.4 |

The measurements were made in dBA. Based on this test, the Tomarco "Powder-Puff" is quieter than the Powers P3500 by 9.8 dBA. The Tomarco "Powder-Puff" is quieter than the Ramset Viper by 7.65 dBA. The Tomarco "Powder-Puff" is quieter than the Hilti DX351 by 4.7 dBA.

The standard rule of thumb recognized in the acoustical community is that 10 dB is subjectively equivalent to doubling or halving the loudness of a noise. For example, if a sound is 10 dB higher than another sound, most people will say that the 10 dB higher sound is twice as loud. A 5 dB difference in sound is a significant increase or decrease. If a sound is 5 dB higher than another, people will definitely notice that the one is significantly louder. On this basis it can be said that the Tomarco "Powder-Puff" fastening tool is significantly quieter than all of the other tools tested, and is considered to be half as loud as the Powers P3500. The tools against which the "Powder-Puff" was tested are representative samples of the fastener tools available in the market today.

Turning to the structural elements of the tool 10 of the present invention, as shown in FIGS. 1-4 and 10-12, we see that the tool 10 has a receiver housing 14 attached to a handle 12. A barrel 16 is slidably retained in the receiver housing 14. A firing chamber funnel 80 is positioned close to a chamber wall 20, but is biased away from the chamber wall 20 by a spring 38. The forward end 22 of the barrel 16 as oriented in the firing direction of tool 10. A spacer-fastener 118 is slidably disposed in the muzzle bore 31 of nose piece 28, which is attached to the forward end 22 of barrel 16.

Figure 11:
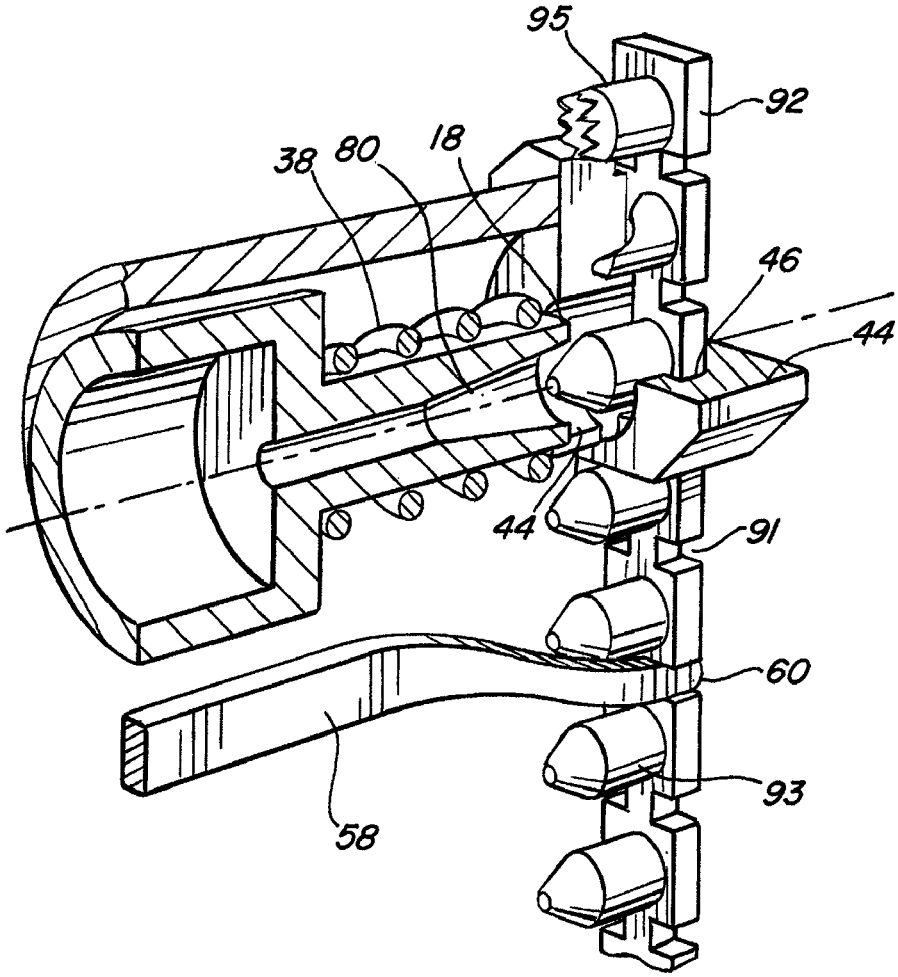
FIG. 11 is a partial perspective cross-sectional view of the chamber and a receiver element for the tool of FIG. 1.
Figure 12:
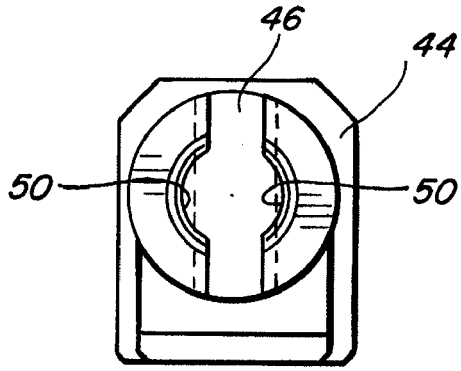
FIG. 12 is an end view of the receiver element of the barrel end of FIG. 11.

The handle 12 has a grip 90 that contains a magazine 48 for holding a multi-cartridge strip 92, having side serrations 91 therein (FIG. 11). The handle 12 has a firing pin housing 32 with a firing pin actuator and cocking element operable by a trigger 96 to activate firing pin 98. The firing pin 98 is slidably disposed in a firing pin bore 30.

The receiver housing 14 has a central housing portion with a barrel bore formed therein for slidably receiving the barrel 16. The firing pin housing 32, which is attached rearwardly of the receiver housing 14, is oriented for a firing pin tip 99 to impact a cartridge 93 that may be positioned adjacent to chamber wall 20 of the receiver firing chamber 44. A concave notch may be formed in the walls of the cartridge channel 46, axial aligned with the barrel bore 26 to form the receiver firing chamber 44.

A multi-cartridge strip advancing arm 58 is attached to a lower portion of receiver housing 14. The advancing arm 58 is pivotally attached to the housing 14 by pin 68. The advancing arm 58 has a lever end 60 that extends to engage the side serrations 91 of the multi-cartridge strip (FIG. 11). The advancing arm 58 also has a cam end 62 extending opposite the lever end 60, the cam end 62 engaging barrel notch 64.

The barrel 16 may be generally cylindrically shaped or multi-faced with a generally uniform outer diameter having a small diameter chamber end 18. The diameter of the chamber end 18 is preferably sized to slide into the receiver firing chamber 44 after a cartridge 93 is positioned in the chamber 44. Firing chamber funnel 80 is only open to the barrel bore 26.

The barrel bore 26 contains a piston 82 with a piston rod 84 projecting forwardly with a piston rod tip 86 disposed in contact with the head 105 of the spacer-fastener 118. The piston rod 84 is adapted to slidably travel within the bore 31 of muzzle nose piece 28 in both directions, to allow insertion of spacer-fastener 118 and to forcibly eject spacer-fastener 118.

A slot 78 is formed in the barrel 16 outer surface intermediate to the forward end 22 and positioned for engagement with a barrel retainer 70 that is rotatably retained in barrel arm 66 (FIG. 10) in slot 78 which does not penetrate through the barrel wall. The barrel retainer preferably has a circular retainer rod 72 with a flat portion 74 and a lever arm 76 (FIG. 10). To insert or remove the barrel 16 from the receiver housing 14, the barrel retainer lever arm 76 is rotated to position the flat portion 74 so that the barrel 16 can slide thereover. The barrel retainer 70 may then be rotated to position the circular portion of the retainer rod 72 in slot 78. The length of the slot 78 determines the actual distance the barrel 16 may slide in receiver housing 14.

The barrel 16 is preferably threaded internally at the forward end 22 for threadable attachment of nose piece muzzle 28, that has external threads. The nose piece muzzle 28 may have one or more flat surfaces 36 formed in the outer surface for use with a wrench or other tool to tighten the nose piece muzzle 28 to the barrel 16.

The tool is operated to drive a spacer-fastener 118 as follows. A multi-cartridge strip is first inserted into the magazine 48. A spacer-fastener 118 is then disposed in nose piece muzzle 28, thereby positioning the piston 82 against the trailing end 27 of the barrel bore 26 adjacent to chamber end 18. The nose piece muzzle 28 is then pressed against a working surface 102 of a structural element to urge the barrel 16 into the receiver housing 14 against the force of spring 38. This causes the advancing arm 58 to rotate around pin 68 to advance a cartridge 93 to the receiving firing chamber as the barrel moves backward into the receiver housing 14. This essentially cocks the explosive discharge actuated tool 10 so the firing chamber funnel 80 is positioned over the cartridge 93. The trigger 96 may now be pulled to cause the firing pin 98 to detonate the cartridge 93. Detonation releases explosive gas pressure that is directed by the firing chamber funnel 80 to piston 82 and piston rod 84 and directly to spacer-fastener 118 driving it into work surface 102 of the structural element.

While the invention has been particularly shown and described with respect to the illustrated embodiments, it will be understood by those skilled in the art that changes in form and details may be made to the foregoing without departing from the spirit and scope of invention.

What is claimed is:

1. An explosive discharge actuated tool using a loaded cartridge for driving fasteners, comprising:

a barrel (16) having a bore (26) with a leading end (29) and a trailing end (27), the bore length being shorter than the barrel length, the bore (26) having an opening only at a firing chamber funnel (80) at the trailing end (27) of the bore and at a muzzle aperture (33) at the leading end (29)

of the bore, the firing chamber funnel (30) covering the loaded cartridge in the firing chamber (44) prior to the cartridge exploding thereby directing the resulting force down the bore (26);

a muzzle nose piece (28) having a predetermined length with a leading and trailing end, and a muzzle bore (31), extending from the trailing to leading end of the nose piece that is smaller in diameter than the diameter of the barrel bore (26), the trailing end of the muzzle nose piece (28) being attached to the forward end (22) of the barrel (16);

a piston (82) with a leading end and a trailing end (83), sized to fit the barrel bore (26) and having a length that is less than the length of the barrel bore (26);

a piston rod (84) having a leading and trailing end attached to the leading end of the piston (82) by the trailing end of the piston rod (84), the piston rod having a diameter sized to fit the muzzle bore (31) and a length selected to provide a predetermined distance between the leading end of the piston rod (84) and the leading end of the muzzle nose piece (28), when the piston (82) is in firing position; and a spacer-fastener (118) having a length equal to the predetermined distance between the leading end of the piston rod (84) and the leading end of the muzzle nose piece (28), and a diameter sized to fit into the muzzle bore (31);

whereby inserting the spacer-fastener (118) into the muzzle bore (31), after the tool has discharged, so that the spacer-fastener (118) does not extend beyond the leading end of the muzzle nose piece (28), moves the piston rod (84) and piston (82) into firing position with the trailing end of the piston (82) at the trailing end (83) of the barrel bore (26) and the trailing end of the spacer-fastener (118) and leading end of the piston rod (84) being in physical contact, before firing.

2. The tool of claim 1 wherein the muzzle nose piece (28) has a threaded trailing end (34) that is threaded into the forward end (22) of the barrel (16).

3. The tool of claim 1 wherein the firing chamber funnel (80) at the trailing end (27) of the barrel bore (26) directs all the explosive discharge into the barrel (26) at the trailing end (83) of the piston (82).

4. The tool of claim 1 wherein the muzzle nose piece (28) is interchangeable with different length muzzle nose pieces, as required to accommodate different length spacer-fasteners (118).

5. The tool of claim 1 wherein the spacer-fastener comprises:

a fastening nail (101) with a leading point (86) and a trailing head (105), the head (105) being in physical contact with the leading end (86) of the piston rod (84); and a spacer (100) having a leading and trailing end, the leading point (86) of the fastening nail (101) being inserted into the trailing end of the spacer (100).

6. The tool of claim 5 wherein the spacer (100) is a cylinder with an aperture (111) in the cylinder wall and a split knob (109) at the leading end.

7. The tool of claim 6 further comprising a fastener clip (104) attached to the leading end of the spacer (100) by the split knob (109).

8. The tool of claim 1 wherein the leading end of the muzzle nose piece (28) is concave.

9. The tool of claim 8 wherein the spacer-fastener comprises:

a fastening nail (101) with a leading point (86) and a trailing head (105), the head (105) being in physical contact with the leading end (86) of the piston rod (84); and a spacer (100) having a leading and a trailing end, the leading point (86) of the fastening nail (101) being inserted into the trailing end of the spacer (100).

10. The tool of claim 9 wherein the spacer (100) a cylinder with an aperture (111) in the cylinder wall and a split knob (109) at the leading end.

11. The tool of claim 10 further comprising a fastener clip (104) attached to the leading end of the spacer (100) by the split knob (109).

12. The tool of claim 11 wherein the fastener clip (104) has a convex surface (119, 120) at the attachment to the spacer (100) that mates with the concave leading end of the muzzle nose piece (28).

13. The tool of claim 12 wherein the fastener clip (104) has an aperture (121, 123) in the convex surface (119, 120) with the split knob (109) passing through the aperture to attach the spacer (100) to the fastener clip (104).

14. The tool of claim 13 wherein the fastener clip is L-shaped with the convex surface on one leg of the L.

15. The tool of claim 10 wherein the cylindrical spacer (100) has a diameter that fits within the diameter of the muzzle bore (31) and the diameter of the split knob (109) is no greater than the diameter of the cylindrical spacer (100).

16. An explosive discharge actuated tool using a loaded cartridge for driving fasteners, comprising:

a barrel (16) having a bore (26) with a leading end (29) and a trailing end (27), the bore length being shorter than the barrel length, the bore (26) having an opening only at a firing chamber funnel (80) at the trailing end (27) of the bore and at a nozzle aperture (33) at the leading end (29) of the bore, the firing chamber funnel (30) covering the loaded cartridge in the firing chamber (44) prior to the cartridge exploding thereby directing the resulting force down the bore (26);

a muzzle nose piece (28) having a predetermined length with a leading and trailing end, and a muzzle bore (31), extending from the trailing to leading end of the nose piece that is smaller in diameter than the diameter of the barrel bore (26), the trailing end of the muzzle nose piece (28) being attached to the forward end (22) of the barrel (16);

a piston (82) with a leading end and trailing end (83), sized to fit the barrel bore (26) and having a length that is less than the length of the barrel bore (26); and a piston rod (84) having a leading and trailing end attached to the leading end of the piston (82) by the trailing end of the piston rod (84), the piston rod having a diameter sized to fit the muzzle bore (31) and a length selected to provide a predetermined distance between the leading end of the piston rod (84) and the leading end of the muzzle nose piece (28), when the piston (82) is in firing position.

17. The tool of claim 16 wherein the muzzle nose piece (28) has a threaded trailing end (34) that is threaded into the forward end (22) of the barrel (16).

18. The tool of claim 16 wherein the firing chamber core (80) at the trailing end (27) of the barrel bore (26) directs all the explosive discharge into the barrel bore (26) at the trailing end (83) of the piston (82).

19. The tool of claim 16 wherein the muzzle nose piece (28) is interchangeable with different length muzzle nose pieces.

* * * * *